United States Patent [19]

Shaw et al.

[11] Patent Number: 4,864,297

[45] Date of Patent: Sep. 5, 1989

[54] SIREN DETECTOR

[75] Inventors: Brian Shaw; J. Lloyd Hargrove, both of Vancouver, Canada

[73] Assignee: Tekedge Development Corp., Vancouver, Canada

[21] Appl. No.: 108,807

[22] Filed: Oct. 14, 1987

[51] Int. Cl.[4] ..... G08G 1/00

[52] U.S. Cl. ..... 340/902; 340/925; 340/906; 340/944; 367/197

[58] Field of Search ..... 340/902, 906, 901, 825.31, 340/943, 925, 944; 367/197, 199

[56] References Cited

U.S. PATENT DOCUMENTS

| | | | |
|---|---|---|---|
| Re. 28,100 | 8/1974 | Long . | |
| 2,355,607 | 8/1944 | Shepherd . | |
| 3,014,199 | 12/1961 | Dill et al. | 340/902 |
| 3,638,179 | 1/1972 | Coll et al. . | |
| 3,784,970 | 1/1974 | Simpkin . | |
| 3,867,719 | 2/1975 | Perrin | 340/902 |
| 3,873,963 | 3/1975 | Neal et al. | 340/902 |
| 3,881,169 | 4/1975 | Malach . | |
| 3,992,656 | 11/1976 | Joy . | |
| 4,158,190 | 6/1979 | Stefanov . | |
| 4,162,477 | 7/1979 | Munkberg . | |
| 4,209,769 | 1/1980 | Chronerberry | 340/902 |
| 4,212,085 | 7/1980 | Vaillancour et al. | 340/902 |
| 4,223,295 | 9/1980 | Bonner et al. . | |
| 4,321,589 | 3/1982 | King . | |
| 4,380,004 | 4/1983 | Coats et al. | 340/902 |
| 4,443,783 | 4/1984 | Mitchell . | |
| 4,587,522 | 5/1986 | Warren | 340/902 |
| 4,625,206 | 11/1986 | Jensen | 340/902 |
| 4,759,069 | 7/1988 | Bernstein et al. | 340/902 |

FOREIGN PATENT DOCUMENTS

| | | | |
|---|---|---|---|
| 0179348 | 9/1985 | Japan | 340/902 |

*Primary Examiner*—Gerald L. Brigance

*Attorney, Agent, or Firm*—Workman, Nydegger & Jensen

[57] ABSTRACT

A siren detector for detecting siren sounds which precess at known yelp, wail and high-low warble rates within a selected frequency band. A transducer detects siren sounds and produces a corresponding electrical output signal. The output signal is filtered to reject signal frequencies outside the selected frequency band. The signal amplitude is monitored and varied as required to produce a constant amplitude output signal. The constant amplitude output signal is low pass filtered for detection of siren high-low sounds and is also low pass filtered for detection and output of precession signals which pass through a selected center frequency. Subsequent filters are provided for detecting signals which vary at the wail and yelp warble rates. Wail, high-low and yelp warble rate signals output by the various filters respectively trigger wail and yelp clock generators which in turn drive don't walk and red light output flip-flops respectively. Operation of the red light output flip-flop is controlled by a delay mechanism which provides a further filtration level to prevent false triggering.

13 Claims, 4 Drawing Sheets

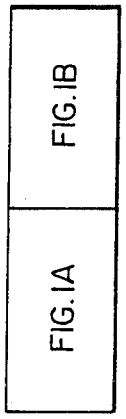
FIG. IC
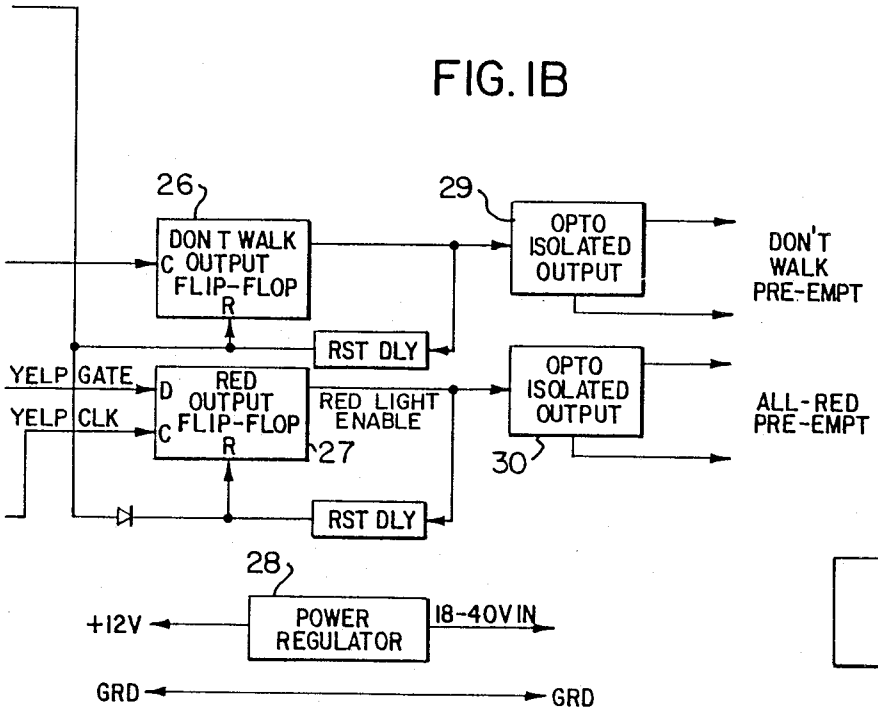
FIG. IB

W DON'T WALK PRE-EMPT
X
ALL RED PRE-EMPT
F
H

YCLK

SIREN DETECTOR

FIELD OF THE INVENTION

This application pertains to a siren detector for detecting siren sounds which precess within a selected frequency band. By detecting siren sounds emitted by an emergency vehicle, the detector facilitates pre-emptable control of traffic lights to enable the vehicle to pass through a traffic intersection on a priority basis.

BACKGROUND OF THE INVENTION

The prior art has evolved various ways of controlling or "pre-empting" vehicle traffic lights to stop traffic at an intersection so that an emergency vehicle may pass unimpeded through the intersection on a priority basis. One technique involves the placement of a special transmitter in each emergency vehicle which is to be allowed priority passage through intersections. The traffic light controllers at each pre-emptable intersection are equipped with a receiver which receives signals transmitted by the transmitter and thereupon actuates the traffic lights to stop the normal flow of traffic. However this technique is relatively expensive and is cumbersome in that personnel in the emergency vehicle must manually actuate the transmitter in order to control the traffic lights.

Traffic light controllers ar pre-emptable intersections have also been equipped with detectors capable of detecting flashing lights (normally special strobe lights) mounted on each emergency vehicle which is to be allowed priority passage through the pre-emptable intersections. In essence, this is similar to the system mentioned in the preceding paragraph, in that the emergency vehicle light replaces the special transmitter. The system does however enjoy something of a cost and utility advantage over the system mentioned in the preceding paragraph, since emergency vehicles are normally equipped with flashing lights which are actuated in emergency situations. However, the cost advantage diminishes if special lights must be provided in order to actuate the detector circuitry which interfaces with the traffic signal controller. Moreover, the inventors believe that such systems are susceptible to false alarm triggering because, so far as the inventors are aware, there are no regulations prohibiting the use of flashing lights on non-emergency vehicles. Accordingly, private individuals driving non-emergency vehicles may disrupt such systems by equipping their vehicles with flashing lights for the express purpose of actuating the detectors which interface with the traffic light controllers.

In the inventors' view a better solution is to devise circuitry capable of detecting the sounds produced by emergency vehicle sirens. There is a clear cost advantage to this approach, in that emergency vehicles are conventionally equipped with sirens (i.e. the emergency vehicles do not need to be equipped with additional special purpose equipment) and a utility advantage in that such sirens are normally activated in emergency situations (i.e. no separate manual actuation of additional special purpose equipment is required). A further advantage is that regulations do exist which prohibit the use of sirens on non-emergency vehicles.

The prior art has evolved a number of circuits for detecting siren sounds. However, the inventors consider these to be problematic in that they are susceptible to false alarm triggering by sounds emanating from sources other than emergency vehicle sirens. The present invention provides a siren detector for detecting siren sounds within a selected frequency band and having superior immunity to false alarm triggering by sounds emanating from sources other than emergency vehicle sirens.

SUMMARY OF THE INVENTION

The invention provides a siren detector for detecting siren sounds which precess at known yelp and wail warble rates within a selected frequency band. The detector comprises transducer means for detecting siren sounds and for producing an electrical output signal representative thereof; first filter means for filtering the signal to reject signal frequencies outside the selected frequency band; signal amplitude control means for monitoring the amplitude of filtered signals output by the first filter means and for varying the filtered signal gain to produce a constant amplitude output signal; second filter means for low pass filtering the constant amplitude output signal for detection therein and output of precession signals passing through a selected centre frequency; third filter means for filtering the precession signals for detection therein of signals which vary at the wail warble rate and for producing a wail rate signal in response thereto; and, fourth filter means for filtering the precession signals for detection therein of signals which vary at the yelp warble rate and for producing a yelp rate signal in response thereto.

Preferably, the siren detector is also capable of detecting siren sounds which precess between known frequencies at a known high-low warble rate. In such case, the detector may further comprise a fifth filter means for low pass filtering the aforementioned constant amplitude output signal for detection therein of signals characteristic of a low frequency component of a siren high-low sound; and, sixth filter means for further low pass filtering the constant amplitude output signal for detection therein of signals which vary at the high-low warble rate and for producing a high-low rate signal in response thereto.

Wail clock means are provided for producing a wail timing signal in synchronization with the wail rate signal output by the third filter means; and, yelp clock means are provided for producing a yelp timing signal in synchronization with the yelp rate signal output by the fourth filter means. If the siren detector has high-low sound detection capability as aforesaid, then the wail timing signal is also produced in synchronization with the high-low rate signal output by the sixth filter means. A yelp gate means is provided for delaying the yelp timing signal to produce a yelp gate signal during the period of the yelp rate signal.

A sensitivity selector means may be provided for adjusting the sensitivity of the siren detector to reject sounds below a selected threshold intensity level.

Preempt control means are provided for activating the siren detector as the siren sounds increase in intensity and for deactivating the siren detector as those sounds fade.

Don't walk output means controllable by the wail clock means and by the preempt control means are also provided. The don't walk output means is for producing a don't walk preempt output signal in response to the wail timing signal while the preempt control means activates the detector.

The don't walk preempt output signal may be applied to a conventional traffic signal light controller in order to switch the pedestrian walk signal (if one is present) to "don't walk" (i.e. the intersection is closed to pedestrian traffic at a relatively early stage, upon detection of distant siren wail sounds). A red light output means is similarly provided. The red light output means is controllable by the yelp clock means by the yelp gate means, and also by the preempt control means. The red light output means is for producing a red light preempt signal in response to the yelp timing and yelp gate signals while the preempt control means activates the detector.

The red light preempt signal may be similarly applied, via a conventional signal light controller, to switch all of the vehicle traffic lights at the intersection to red (i.e. the intersection is closed to vehicle traffic when the emergency vehicle personnel switch the vehicle's siren to yelp more as the vehicle nears the intersection).

BRIEF DESCRIPTION OF THE DRAWINGS

FIGS. 1A, 1B & 1C are a block diagram illustrating the basic operation of a siren detector according to the invention.

DETAILED DESCRIPTION OF THE PREFERRED EMBODIMENT

Emergency vehicle sirens commonly emit sounds which precess between about 400 Hz. and 1400 Hz. These sounds comprise a "wail" sound, which precesses from the low frequency (400 Hz.) to the high frequency (1400 Hz.) and then back to the low frequency at a nominal rate of 10 times per minute (the "wail warble rate"); a "yelp" sound, which precesses from the low frequency to the high frequency and then back to the low frequency at a nominal rate of 180 times per minute (the "yelp warble rate"); and, a "high-low" sound, which precesses between 400 Hz. and 600 Hz. at a nominal rate of once per second (the "high-low warble rate"). The siren detector of the present invention is thus designed to detect siren sounds which precess at the rates aforesaid within a 400 Hz.–1400 Hz. frequency band and to do so in a manner which maximizes the likelihood of reliably detecting such sounds, while minimizing the likelihood of interpreting non-siren sounds as though they were siren sounds and consequently generating false alarm signals.

Figure 1A:
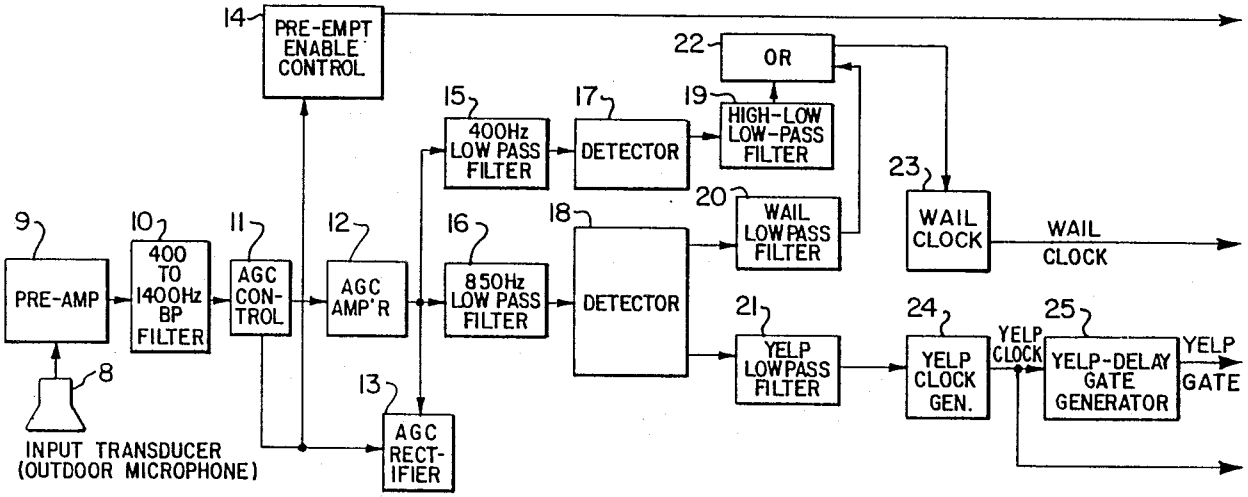

FIG. 1 is a block diagram which illustrates the basic operation of a siren detector constructed in accordance with the invention. A brief overview of the invention will first be provided with reference to FIG. 1. A detailed description of the preferred embodiment will then be provided with reference to FIG. 2, which is an electronic circuit schematic diagram of the preferred siren detector.

With reference to FIG. 1, the siren detector utilizes a weatherproof microphone 8 which is placed in a suitable location at an intersection having traffic lights which are to be controlled upon detection of sounds emitted by emergency vehicle sirens. Microphone 8 constitutes a "transducer means" for detecting siren sounds and for producing an electrical output signal representative of those sounds.

Input preamplifier 9 serves as a "sensitivity selector means" for adjusting the sensitivity of the siren detector to reject sounds below a selected sound intensity level. The gain of input preamplifier 9 is typically adjusted to limit the preamplifier's response to sounds emitted by emergency vehicle sirens originating within approximately a one half block radius of the intersection which is to be controlled.

Band pass filter 10 serves as a "first filter means" for filtering the output of preamplifier 9 to reject signal frequencies which lie outside the 400 Hz. to 1400 Hz. sweep frequency range characteristic of emergency vehicle sirens. An automatic gain control circuit or "signal amplitude control means" comprising A.G.C. controller 11, A.G.C. amplifier 12 and A.G.C. rectifier 13 limits the amplitude of signals output by band pass filter 10. Preempt enable control 14 monitors the A.G.C. control voltage, enables the circuit via the "reset" inputs of each of output flip-flops 26 and 27 when the A.G.C. control voltage rises above a threshold indicative of the detection of signal frequencies in the 400–1400 Hz. range, and disables the circuit via the same reset inputs when the A.G.C. control voltage falls below the threshold aforesaid. Preempt enable control 14 normally holds the circuit in the disabled state by supplying reset signals to flip-flops 26 and 27 and enables the circuit in the circumstances aforesaid by removing those reset signals.

A "second filter means", namely low pass filter 16 tuned to the geometric mean frequency of the siren sweep frequency range (i.e. about 850 Hz.) detects cyclic precession, through the aforementioned mean frequency, of the constant amplitude full bandwidth signal output by A.G.C. amplifier 12. The "precession signal" output by low pass filter 16 is converted to a varying D.C. voltage by detector 18 and is then fed to each of wail low pass filter 20 and yelp low pass filter 21 which serve, respectively, as "third" and "fourth filter means" for detecting signals which vary at the wail and yelp warble rates aforesaid and for outputting wail and yelp rate signals respectively in response thereto.

A "fifth filter means", namely high-low low pass filter 15 detects the low frequency of the high-low signal (i.e. 400 Hz.). The signal output by filter 15 is converted to a varying D.C. voltage by detector 17 and is then fed through a "sixth filter means", namely low pass filter 19 which is optimally configured for detecting signals which vary at the high-low warble rate aforesaid and for outputting a high-low rate signal in response thereto. The filter outputs are level switched and wail and high-low signals are differentiated and OR'd together by OR gate 22.

The signals output by filter 20 and OR gate 22 are level switched and then fed to wail clock generator 23. Similarly, the signals output by filter 21 are level switched and fed to yelp clock generator 24. The two clock generators are each positive edge triggered one-shot multivibrators. Wail clock generator 23 outputs a wail clock pulse whenever the signal levels output by either of filters 19 or 20 drop from high to low. Similarly, yelp clock generator 24 outputs a yelp clock pulse whenever the signal level output by filter 21 drops from high to low.

The wail clock pulse output by wail clock generator 23 sets wail output flip-flop 26 high, thereby enabling that flip-flop. Don't walk output flip-flop 26 is disabled either by the reset signal supplied by preempt enable control 14; or, on automatic time-out if another wail clock pulse is not applied to don't walk output flip-flop 26 within about 1.5 cycles of the wail warble rate. The output of don't walk flip-flop 26 is coupled, via opto coupler 29, to the don't walk wail preempt input terminals of a conventional traffic light controller (assuming that the controller in question is equipped with wail capability).

The yelp clock pulse output by yelp clock generator 24 is delayed for about nine tenths of one yelp period by a "yelp gate means", or yelp delay gate generator 25. The delayed yelp gate signal enables the "D" input of red light output flip-flop 27 and ensures that the flip-flop can be enabled only for an interval representing two tenths of one yelp period, beginning with the period after the yelp clock pulse, and remains disabled during the remaining eight tenths yelp period. The yelp clock pulse output by yelp clock generator 24 is also applied directly to the "C" input of red light output flip-flop 27. Pulses applied to the "C" input of red light output flip-flop 27 within the flip-flop enable interval aforesaid set red light output flip-flop 27 high, thereby enabling that flip-flop. Pulses applied to the "C" input of red light output flip-flop 27 outside the flip-flop enable interval aforesaid set flip-flop 27 low, thereby disabling that flip-flop. Flip-flop 27 is also disabled by the reset signal supplied by preempt enable control 14. Because the yelp delay period is determined by yelp clock pulses produced during the immediately preceding period, flip-flop 27 is enabled only during receipt of a continuous string of yelp clock pulses having the appropriate period ±10% and is disabled in all other situations. This ensures accurate tracking of siren yelp sounds, while allowing for ±10% variation between individual sirens. The output of red light output flip-flop 27 is coupled, via opto coupler 30, to the "all red" preempt input terminals of the traffic light controller.

It will thus be understood that flip-flops 26 and 27 are normally held in the "reset" state by preempt enable control 14 and therefore no output signals are supplied to the traffic light controller. Either flip-flop may be set as aforesaid by the application of a wail or yelp clock pulse to the appropriate flip-flop "C" input and by prior sustained removal of the flip-flop reset signals by preempt enable control 14. Power regulator 28 provides +12 volt D.C. power for the circuit from an input voltage varying from eighteen to forty volts or from an external 18 volt D.C. power supply.

Figure 2A:
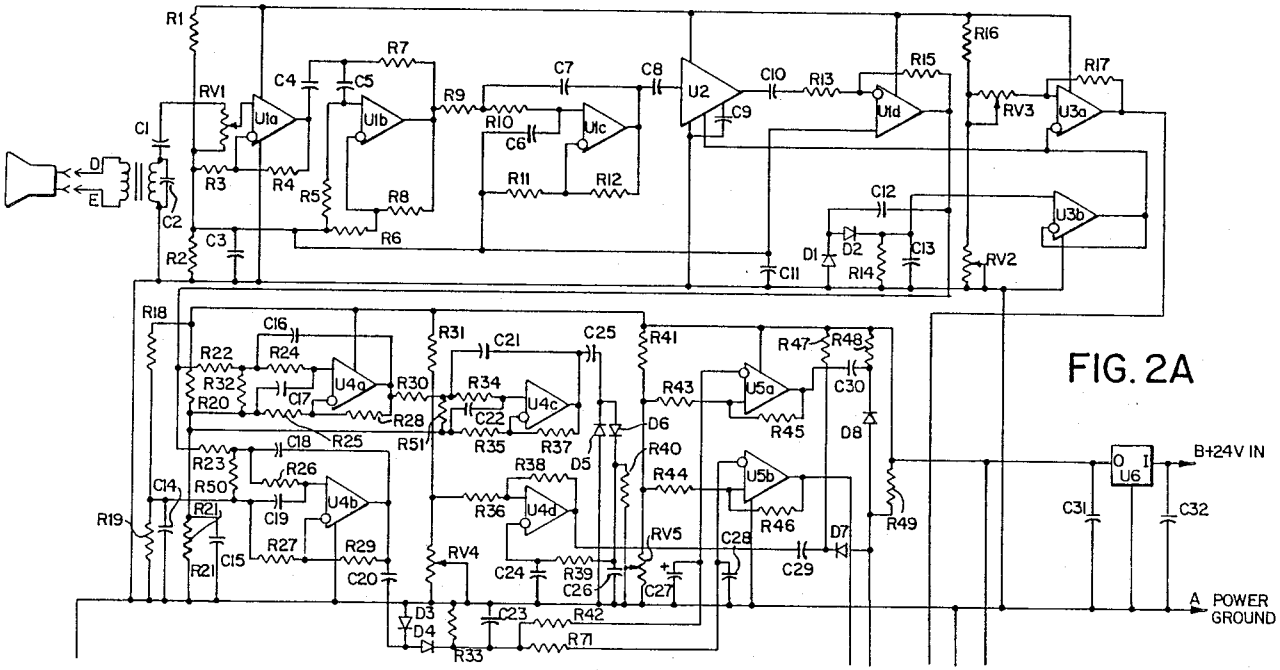
FIGS. 2A, 2B & 2C are an electronic circuit schematic diagram of a siren detector constructed in accordance with the preferred embodiment of the invention.
Figures 2A, 2B, 2C:
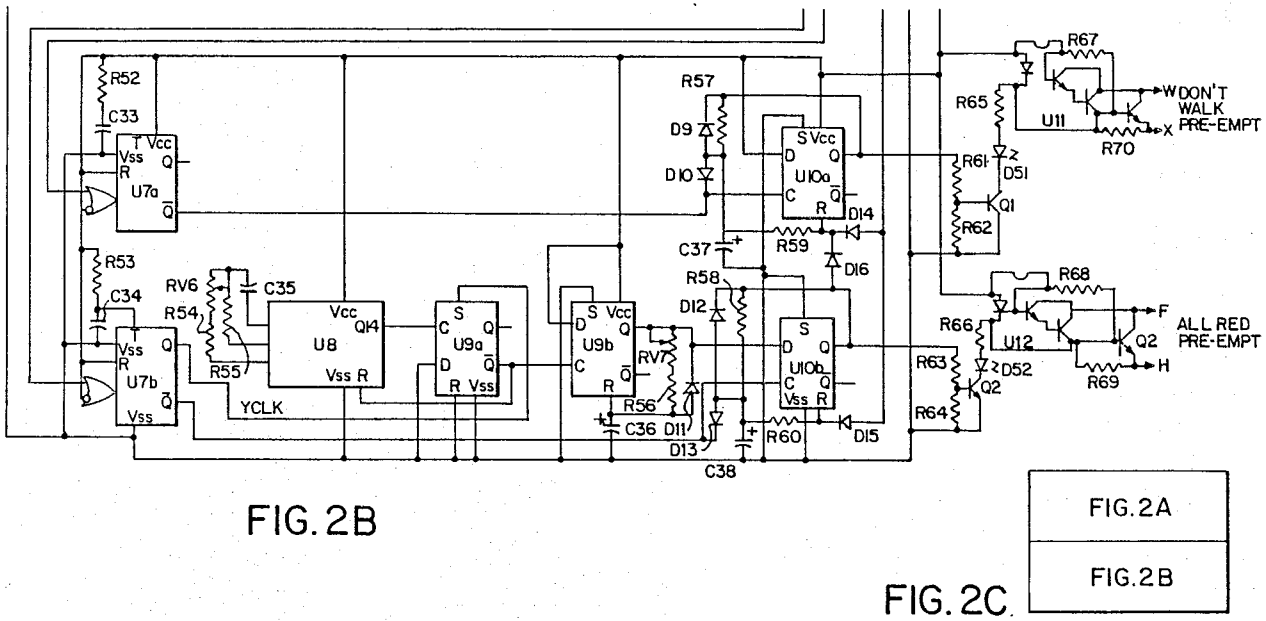

A detailed description of the preferred embodiment is now provided with reference to FIG. 2. Sounds detected by microphone MIC 1 are converted by the microphone transducer into representative electrical signals. Operational amplifier U1*a* and its associated components (i.e. matching transformer T1, resistors R1–R4, capacitors C1–C3 and C11, and variable resistor RV1) constitute input preamplifier 9, the gain of which may be adjusted with the aid of variable resistor RV1, thereby adjusting the sensitivity of the circuit to reject sounds below a selected sound intensity level. In the preferred embodiment, the preamplifier gain is adjusted to detect sounds emitted by emergency vehicle sirens within a radius of about one half block of the traffic intersection which is to be controlled. RV1 is also adjusted so that the wail detector circuitry has time to stabilize (about four seconds) before the A.G.C. control voltage reaches the threshold at which preempt enable control 14 enables the circuit.

Operational amplifier U1b and its associated resistors and capacitors (R5–R8 and C4–C5) comprise a high pass filter tuned to reject signal frequencies below 400 Hz. Operational amplifier U1c and its associated resistors and capacitors (R9–R12 and C6–C7) comprise a low pass filter tuned to reject signal frequencies above 1400 Hz. These two filters together comprise the "first filter means" aforesaid; namely, band pass filter 10.

A.G.C. control 11 is formed by electronic attenuator U2, together with capacitors C8 and C9. Operational amplifier U1d, together with its associated resistors and capacitors (R13, R15 and C10A & C10B) form A.G.C. amplifier 12. Operational amplifier U3b together with resistor R14, capacitors C12–C13 and diodes D1–D2 form A.G.C. rectifier 13. More particularly, the components which make up A.G.C. rectifier 13 comprise an output level detector, the output of which is fed back to the control input of electronic attenuator U2 to hold the signal amplitude output by attenuator U2 to a constant level over the entire 400 Hz.–1400 Hz. bandwidth of the siren detector.

Operational amplifier U3*a* together with resistors R16, R17 and variable resistors RV2 and RV3 form preempt enable control 14. These components comprise a level detector for determining when the siren detector enable and disable threshold levels have been met. The enable threshold level is adjusted with the aid of variable resistor RV2 and the disable threshold level is adjusted with the aid of variable resistor RV3.

High-low low pass filter 15 consists of two filter stages, namely operational amplifier U4*a* together with its associated resistors and capacitors (R22, R24, R25, R28, R32 and C16, C17) followed by operational amplifier U4*c* together with its associated resistors and capacitors (R30, R34, R35, R37, R51 and C21, C22). Resistors R20, R21 and capacitor C15 serve as a bias source for the dual stage filter. Detector 17 consists of resistors R40, capacitors C25, C26 and diodes D5, D6. High-low low pass filter 19 is formed by resistor R39 and capacitor C24, with level detection provided by operational amplifier U4*d* and its associated resistors (i.e. R31, R36, R38 and variable resistor RV4). OR gate 22 consists of the differentiators formed by C30–R48 and C29–R47 and diodes D7 and D8 together with R49.

Operational amplifier U4*b* together with its associated resistors and capacitors (i.e. R23, R26, R27, R29, R50 and C18, C19) together comprise low pass filter 16 (R18, R19 and C14 serve as a bias source for U4*b*). Detector 18 consists of capacitors C20 and C23, resistor R33 and diodes D3–D4. Wail low pass filter 20 is made up of RC network R42, C27 plus operational amplifier U5*a* in combination with resistors R41, R43, R45 and RV5. Yelp low pass filter 21 is made up of RC network R71, C28 plus operational amplifier U5*b* in combination with resistors R41, R44, R46 and RV5. Regulator U6 in combination with capacitors C31 and C32 serves as power regulator 28.

Monostable multivibrator U7*a* together with resistor R52 and capacitor C33 make up wail clock generator 23. Monostable multivibrator U7*b* together with resistor R53 and capacitor C34 make up yelp clock generator 24. Yelp delay gate generator 25 is made up of delay generation oscillator/counter U8 in combination with resistors R54, R55, variable resistor RV6 and capacitor C35, together with control flip-flop U9*a*. Gate generator U9*b* is configured as a one shot monostable multivibrator (with the aid of resistor R56, variable resistor RV7, capacitor C36 and diode D11) triggered from U9*a* to provide a delayed yelp gate signal as aforesaid.

Wail clock pulses output by flip-flop U7*a* directly set wail output flip-flop U10*a*. Diodes D9 and D10 in combination with capacitor C37 and resistor R57 reset the circuit after about 20 seconds if the wail signal disappears even though the signal amplitude may remain high enough (due to background noise) to activate pre-empt enable control 14. Pre-empt enable control 14 disables the circuit by supplying a reset signal to don't walk flip-flop U10*a* through diode D14 and resistor R59. Diode D16 resets U10*a* when U10*b*'s enabled, thereby preventing simultaneous output of "don't walk" and "all red" preempts, when the all red preempt is present.

Yelp clock pulses output by yelp monostable U7*b* during the delay interval established by yelp delay gate generator 25 set red light flip-flop U10*b*. Diodes D12, D13 in combination with capacitor C38 and resistor R58 reset red light flip-flop U10*b* in the manner described above with reference to don't walk flip-flop U10*a*. Preempt enable control 14 disables the circuit by supplying a reset signal to flip-flop U10*b* through diode D15 and resistor R60.

Resistors R61 and R62 in combination with transistor Q1 form a wired OR buffer driver coupled via light emitting diode DS1 and resistor R65 to opto coupler U11 which may in turn be coupled to the traffic controller don't walk preempt input terminals. DS1 provides a visual indication of circuit detection of siren high-low or wail signals sufficient to result in preemption of the pedestrian don't walk signal. Similarly, resistors R63, R64 in combination with transistor Q2 form a wired OR buffer driver coupled via light emitting diode DS2 and resistor R66 to opto coupler U12 which may in turn be coupled to the traffic controller's "all red" preempt input terminals. DS2 provides a visual indication of circuit detection of siren yelp sounds sufficient to result in preemption of the traffic "red" lights.

The following table provides component values suitable for construction of a siren detector for detecting sounds emitted by emergency vehicle sirens.

| Resistors | Value | Capacitors | Value |
|---|---|---|---|
| R1 | 10K | C1 | 0.1 ufd 10% 50 V |
| R2 | 10K | C2 | .15 ufd 10% 50 V |
| R3 | 3.3K | C3 | 47 ufd 10% 16 V |
| R4 | 47K | C4 | .01 ufd 5% 100 V |
| R5 | 39.2K 1% | C5 | .01 ufd 5% 100 V |
| R6 | 39K | C6 | .01 ufd 5% 100 V |
| R7 | 39.2K 1% | C7 | .01 ufd 5% 100 V |
| R8 | 39K | C8 | .22 ufd 10% 50 V |
| R9 | 12.1K 1% | C9 | 680 pfd 10% 50 V |
| R10 | 12.1K 1% | C10 | .22 ufd 10% 50 V |
| R11 | 39K | C10A | 2.2 ufd 20% 16 V |
| R12 | 39K | C10B | 2.2 ufd 20% 16 V |
| R13 | 3.3K | C11 | 1,000 ufd 20% 16 V |
| R14 | 10K | C12 | 2.2 ufd 20% 16 V |
| R15 | 220K | C13 | 47 ufd 10% 16 V |
| R16 | 3.3K | C14 | 10 ufd 20% 16 V |
| R17 | 39K | C15 | 10 ufd 20% 16 V |
| R18 | 10K | C16 | .01 ufd 5% 100 V |
| R19 | 10K | C17 | .01 ufd 5% 100 V |
| R20 | 10K | C18 | .01 ufd 5% 100 V |
| R21 | 10K | C19 | .01 ufd 5% 100 V |
| R22 | 68K | C20 | .22 ufd 10% 50 V |
| R23 | 56K | C21 | .01 ufd 5% 100 V |
| R24 | 39K | C22 | .01 ufd 5% 100 V |
| R25 | 39K | C23 | 0.1 ufd 10% 50 V |
| R26 | 27.0K 1% | C24 | .22 ufd 10% 50 V |
| R27 | 39K | C25 | .22 ufd 10% 50 V |
| R28 | 39K | C26 | 0.1 ufd 10% 50 V |
| R29 | 39K | C27 | 3.3 ufd 20% 16 V |
| R30 | 68K | C28 | 0.1 ufd 10% 50 V |

-continued

| Resistors | Value | Capacitors | Value |
|---|---|---|---|
| R31 | 3.3K | C29 | 0.1 ufd 10% 50 V |
| R32 | 2.2K | C30 | 0.1 ufd 10% 50 V |
| R33 | 100K | C31 | 10 ufd 20% 16 V |
| R34 | 39K | C32 | 10 ufd 20% 35 V |
| R35 | 39K | C33 | 0.1 ufd 10% 50 V |
| R36 | 1K | C34 | 0.1 ufd 10% 50 V |
| R37 | 39K | C35 | 1000 pfd 5% 100 V |
| R38 | 100K | C36 | 4.7 ufd 20% 16 V |
| R39 | 680K | C37 | 10 ufd 20% 16 V |
| R40 | 100K | C38 | 1.0 ufd 20% 16 V |
| R41 | 3.3K | | |
| R42 | 470K | | |
| R43 | 1.0K | | |
| R44 | 1.0K | | |
| R45 | 100K | | |
| R46 | 100K | | |
| R47 | 100K | | |
| R48 | 100K | | |
| R49 | 100K | | |
| R50 | 56K | | |
| R51 | 68K | | |
| R52 | 100K | | |
| R53 | 100K | | |
| R54 | 10K | | |
| R55 | 100K | | |
| R56 | 10K | | |
| R57 | 470K | | |
| R58 | 100K | | |
| R59 | 100K | | |
| R60 | 100K | | |
| R61 | 10K | | |
| R62 | 10K | | |
| R63 | 10K | | |
| R64 | 10K | | |
| R65 | 820 ohm | | |
| R66 | 820 ohm | | |
| R67 | 1.0M | | |
| R68 | 1.0M | | |
| R69 | 4.7K | | |
| R70 | 4.7K | | |
| RV1 | 50K, 25 turn trimpot | | |
| RV2 | 2K, 25 turn trimpot | | |
| RV3 | 5.0K, 25 turn trimpot | | |
| RV4 | 2K, 25 turn trimpot | | |
| RV5 | 2K, 25 turn trimpot | | |
| RV6 | 50K, 25 turn trimpot | | |
| RV7 | 100k, 25 turn trimpot | | |

Unless otherwise indicated all resistors are 5%, $\frac{1}{4}$ watt.

| Diodes | Component No. |
|---|---|
| D1–D16 | 1N914 or equivalent |
| DS1–DS2 | T13/4 (red LED) |

| Transformer | Description | Component No. |
|---|---|---|
| T1 | Mode Loudspeaker transformer | 60-282-0 |

| Transistors | Description | Component No. |
|---|---|---|
| Q1 | NPN | 2N4401 |
| Q2 | NPN | 2N4401 |

| Loudspeaker | Description |
|---|---|
| MIC1 | 8 ohm, 10 watt outdoor loudspeaker |

| Integrated Circuits | Description | Component No. |
|---|---|---|
| U1 | quad Mos input op amp | TL084 |
| U2 | electronic attenuator | MC3340 |
| U3 | dual op amp | LM358 |

-continued

| | | |
|---|---|---|
| U4 | quad Mos input op amp | TL084 |
| U5 | dual op amp | LM358 |
| U6 | 12 volt .5 amp regulator | 78M12 |
| U7 | dual monostable | CD4538 |
| U8 | oscillator-14 stage binary counter | CD4060 |
| U9 | dual D flip-flop | CD4013BPC |
| U10 | dual D flip-flop | CD4013BPC |
| U11 | Darlington optocoupler | 4N33 |
| U12 | Darlington optocoupler | 4N33 |

In accordance with the foregoing description, it will be understood that as an emergency vehicle with an operating siren approaches an intersection having traffic lights controlled by a controller equipped with the preferred siren detector, the detector will detect the high-low or wail sounds produced by the siren and then preempt the pedestrian don't walk signals at the intersection (assuming that the intersection in question is configured with pedestrian don't walk signals). Thereafter, the emergency vehicle personnel may switch the vehicle siren to produce yelp sounds which are in turn detected by the siren detector to result in preemption of the traffic controller "all red" input, causing the controller to switch all traffic lights at the intersection to red, thereby maximizing the likelihood that the emergency vehicle may pass safely through the intersection. As the emergency vehicle moves away from the intersection, the sounds produced by its siren fall below the siren detector's preset threshold level, causing the detector to disable itself and thereby allowing the traffic controller to revert to normal control of the pedestrian and traffic lights at the intersection.

As will be apparent to those skilled in the art in the light of the foregoing disclosure, many alterations and modifications are possible in the practice of this invention without departing from the spirit or scope thereof. Accordingly, the scope of the invention is to be construed in accordance with the substance defined by the following claims.

We claim:

1. A siren detector for detecting siren sounds which precess at known wail and yelp warble rates within a selected frequency band to facilitate pre-emptable control of traffic lights to enable an emergency vehicle to pass through a traffic intersection on a priority basis, said detector comprising:

(a) transducer means for detecting said sounds and for producing an electrical output signal representative thereof;

(b) first filter means for filtering said signal to reject signal frequencies outside said selected band;

(c) signal amplitude control means for monitoring the amplitude of filtered signals output by said first filter means and for varying the gain of said filtered signals to produce a constant amplitude output signal;

(d) second filter means for low pass filtering said constant amplitude output signal for detection therein and output of precession signals passing through a selected centre frequency;

(e) third filter means for filtering said precession signals for detection therein of signals which vary at said wail rate and for producing a wail rate signal in response thereto; and (f) fourth filter means for additionally filtering said precession signals for detection therein of signals which vary at said yelp rate and for additionally producing a yelp rate signal in response thereto.

2. A siren detector as defined in claim 1, wherein said siren sounds further precess at a known high-low warble rate, said detector further comprising fifth filter means for low pass filtering said constant amplitude output signal for detection therein of signals characteristic of a low frequency component of a siren high-low sound.

3. A siren detector as defined in claim 2, said detector further comprising sixth filter means for low pass filtering said constant amplitude output signal for detection therein of signals which vary at said high-low warble rate and for producing a high-low rate signal in response thereto.

4. A siren detector as defined in claim 1, further comprising:

(a) wail clock means for producing a wail timing signal in synchronization with said wail rate signal output by said third filter means; and, (b) yelp clock means for producing a yelp timing signal in synchronization with said yelp rate signal output by said fourth filter means.

5. A siren detector as defined in claim 4, further comprising yelp gate means for delaying said yelp timing signal to produce a yelp gate signal during said yelp signal period.

6. A siren detector as defined in claim 1, further comprising sensitivity selector means for adjusting the sensitivity of said siren detector to reject sounds below a selected sound intensity level.

7. A siren detector as defined in claim 5, further comprising preempt control means for activating the siren detector as the siren sounds increase in intensity and for deactivating the siren detector as said sounds fade.

8. A siren detector as defined in claim 7, further comprising:

(a) don't walk output means controllable by said wail clock means and by said preempt control means, said don't walk output means for producing a don't walk preempt output signal in response to said wail timing signal, while said preempt control means activates said detector; and, (b) red light output means controllable by said yelp clock means, said yelp gate means, and by said preempt control means; said red light output means for producing a red light preempt output signal in response to said yelp timing and yelp gate signals while said preempt control means activates said detector.

9. A siren detector as defined in claim 3, further comprising:

(a) wail clock means for producing a wail timing signal in synchronization with either:

(i) said wail rate signal output by said third filter means; or, (ii) said high-low rate signal output by said sixth filter means; and, (b) yelp clock means for producing a yelp timing signal in synchronization with said yelp rate signal output by said fourth filter means.

10. A siren detector as defined in claim 9, further comprising yelp gate means for delaying said yelp timing signal to produce a yelp gate signal during said yelp signal period.

11. A siren detector as defined in claim 3, further comprising sensitivity selector means for adjusting the sensitivity of said siren detector to reject sounds below a selected sound intensity level.

12. A siren detector as defined in claim 9, further comprising preempt control means for activating the siren detector as the siren sounds increase in intensity and for deactivating the siren detector as said sounds fade.

13. A siren detector as defined in claim 12, further comprising:

(a) don't walk output means controllable by said wail clock means and by said preempt control means, said don't walk output means for producing a don't walk preempt output signal in response to said wail timing signal, while said preempt control means activates said detector; and (b) red light output means controllable by said yelp clock means, said yelp gate means, and by said preempt control means; said red light output means for producing a red light preempt output signal in response to said yelp timing and yelp gate signals while said preempt control means activates said detector.

* * * * *